United States Patent [19]

Sakai et al.

[11] Patent Number: 4,481,073

[45] Date of Patent: Nov. 6, 1984

[54] PROCESS FOR REMOVING ANTHRAQUINONE TYPE SCALE

[75] Inventors: Kazuaki Sakai, Fujisawa; Tuneyasu Sato, Chigasaki; Kazuhiko Chiba, Kawasaki, all of Japan

[73] Assignee: Kawasaki Kasei Chemicals Ltd., Tokyo, Japan

[21] Appl. No.: 323,131

[22] Filed: Nov. 19, 1981

[30] Foreign Application Priority Data

Dec. 1, 1980 [JP] Japan ..... 55-169297
Dec. 15, 1980 [JP] Japan ..... 55-175745

[51] Int. Cl.[3] ..... D21C 11/10; C23G 1/14

[52] U.S. Cl. ..... 162/30.1; 134/22.13; 134/22.17; 162/30.11; 162/72; 162/199

[58] Field of Search ..... 162/48, 72, 30.1, 30.11, 162/199; 134/2, 22.17, 22.13; 252/105

[56] References Cited

U.S. PATENT DOCUMENTS 4,178,861 12/1979 Vanderhoek et al. ..... 162/72
4,213,821 7/1980 Vanderhoek et al. ..... 162/72
4,263,092 4/1981 Klaessig et al. ..... 162/48

FOREIGN PATENT DOCUMENTS 0137893 10/1979 Fed. Rep. of Germany ... 134/22.13

OTHER PUBLICATIONS

Bloom et al., "Some Effects of Alkali on Corrosion of Mild Steel in Steam Generating Systems", Corrosion--National Association of Engineers, pp. 327–329, Sep. 1963, vol. 19.

*Primary Examiner*—Steve Alvo
*Attorney, Agent, or Firm*—Oblon, Fisher, Spivak, McClelland & Maier

[57] ABSTRACT

A process for removing an anthraquinone type scale comprises condensing a steam evaporated from a black liquor obtained by separating pulp from a digested mixture of lignocelluloses containing an anthraquinone type digesting assistant; and contacting a heated aqueous solution of a base in the presence or absence of a reducing agent or an alkali resistant surfactant with a wall of a condenser of an evaporator on which said anthraquinone type scale is adhered.

9 Claims, No Drawings

PROCESS FOR REMOVING ANTHRAQUINONE TYPE SCALE

BACKGROUND OF THE INVENTION

1. FIELD OF THE INVENTION

The present invention relates to a process for removing scales adhered on equipment, especially condenser surfaces, which are in contact with the vapor produced by the evaporation of a digested mixture of lignocellulose containing anthraquinone during the condensation of a black liquor obtained by separating pulp from the digested mixture.

2. DESCRIPTION OF THE PRIOR ART

It is known that anthraquinone (hereinafter referred to as AQ for 9,10-anthraquinone) and anthraquinone precursors such as anthrahydroquinone (referred to as AHQ), 1,4,4*a*,9*a*-tetrahydroanthraquinone (referred to as THAQ) and 1,4-dihydroanthrahydroquinone (referred to as DDA) are excellent for promoting digestion (cooking or pulping) of lignocellulosic materials, such as wood.

When an AQ or AQ precursor is used as a digesting assistant (cooking additive or pulping additive) for lingocelluloses in the digestion of pulp, 40 to 50 wt. % of the AQ or AQ precursor added remains in the form of AQ or AHQ as a reduced product in the black liquor depending upon the kind of the digesting assistant. The black liquor is usually oxidized and concentrated in a multiple effect evaporator and the concentrated liquid is then fired to burn organic materials and to recover inorganic compounds such as sodium carbonate and sodium sulfide in the case of the kraft process. The inorganic compounds are converted into sodium hydroxide and the product is reused.

In order to improve heat efficiency, steam evaporated at higher temperature is fed into another evaporator at lower temperature containing the black liquor of lower concentration and is used for heating in the next evaporator in the multiple effect evaporator for concentrating the black liquor. In the process, the AQ component in the black liquor is evaporated, together with steam, and fed into a steam heating part of an evaporator at lower temperature in which the steam is condensed to be discharged as a drain. Thus, the AQ component has lower solubility and accordingly, it adheres on a steam heat transferring surface of the evaporator, a pump for discharging, a pipe or another heat exchanger to form a scale whereby the heat exchange efficiency is reduced and the equipment may be clogged.

There has now been provided a simple process for removing the adhered scale with industrial advantages. The composition of the scale has been analyzed and found to contain 20 to 90 wt. % AQ component, 10 to 20 wt. % volatile oily component such as an abietic acid ester derived from lignocellulose and the reminder being inorganic salts.

Since the oily component in the adhered scale imparts an effect as a binder to the scale, the scale is heat-treated in an aqueous solution of sodium hydroxide to hydrolyze the oily component and a reducing agent, such as sodium hydrosulfite is used to dissolve the anthraquinone component. As a result, the oily component as the binder is hydrolyzed to dissolution and the scale is dislodged and the AQ component is easily reduced to dissolve into the aqueous solution and the scale is then easily removed.

SUMMARY OF THE INVENTION

It is an object of the present invention to provide a process for readily removing an anthraquinone type scale.

The foregoing and other objects of the present invention have been attained by a process for removing an anthraquinone type scale which comprises condensing steam evaporated from a black liquor obtained by separating pulp from a digested mixture of lignocelluloses containing an anthraquinone type digesting assistant; and contacting a heated aqueous solution of a base in the presence or absence of a reducing agent or an alkali resistant surfactant with the condenser wall on which said anthraquinone type scale is adhered.

DETAILED DESCRIPTION OF THE PREFERRED EMBODIMENTS

The digested mixture of lingocelluloses containing AQ or a steam distillable AQ compound or the black liquor obtained by separating pulp from the digested mixture (hereinafter referring to digested mixture or black liquor) can be the digested mixture or black liquor obtained by pulping lignocelluloses wth the AQ or the steam distillable AQ compound as the digesting assistant by the steam digestion and the digested mixture or black liquor obtained by pulping lignocelluloses with a precursor of AQ or the steam distillable AQ compound as a digesting assistant by the steam digestion, since the digested mixture or black liquor contains the substantially same components. Thus, the AQ precursor used in the present invention is a compound which is converted into AQ under the digesting condition. The typical AQ precursors include hydro-AQ such as AHQ, THAQ, DDA and disodium salt of DDA (DDANa), 1,4-dihydro-AQ, 1,2,3,4-tetrahydro-AQ, 1,4,4*a*,5,8,8*a*,9*a*,10*a*-octahydro-AQ and also anthrone.

The typical steam distillable AQ compounds include alkyl-AQ such as 2-methyl-AQ, 1-methyl-AQ and 2,3-dimethyl-AQ. The precursor of the steam distillable AQ compounds can be compounds which are converted into steam distillable AQ compounds under digestion conditions. The typical precursors include the aforementioned AQ compounds and hydro-AQ such as AHQ, THAQ, DDA, DDANa, 1,4-dihydro-AQ, 1,2,3,4-tetrahydro-AQ, 1,4,4*a*,5,8,8*a*,9*a*,10*a*-octahydro-AQ and alkyl-anthrone.

The digested mixture and black liquor used in the present invention can be the digested mixture and black liquor obtained by a desired digesting process such as kraft digestion, soda digestion, sulfite digestion, polysulfide digestion, oxygen digestion, and vapor phase digestion etc.

The steam evaporated from the digested mixture is the steam evaporated in the process for blowing the digested mixture at high temperature and high pressure after the digestion of pulp. In order to treat the steam, the steam is condensed to recover heat energy and then, the residue is burned. The present invention provides a method to remove the scale adhered on the equipment and the pipe in the steam treating system. It is important to remove the scale adhered on the equipment and the pipe in the steam treating system from the steam evaporated from the black liquor. The scale is especially easily adhered on the equipment and the pipe in the steam treating system for the steam evaporated by the multiple effect evaporator, in the concentration of the black liquor obtained by separating pulp from the digested mixture. When the steam is fed into the steam heating part of the evaporator for lower concentration at lower temperature the scale especially adheres on the connected knock-down drum discharging pump and drain heat transferring surface of the heat-exchanger which is used to recover heat from the drain, pump and pipe. The scale is especially easily formed in the lower concentration side. In order to remove the scale adhered on the equipment and the pipe, it is not satisfactory to wash with water, but instead an aqueous solution of a base preferably in the presence of a reducing agent is employed.

The base used as the aqueous solution can be an alkali metal hydroxide such as sodium hydroxide and potassium hydroxide; an alkali metal carbonate or bicarbonate such as sodium carbonate, potassium carbonate and sodium bicarbonate and ammonia. It is also possible to use a white liquor or a green liquor. It is especially preferable to use an aqueous solution of sodium hydroxide in view of economy and the excellent effect it imparts. The concentration of the aqueous solution is dependent upon the solubility of the base and is usually in a range from 0.5 wt. % to the solubility of the base. In the case of sodium hydroxide, the concentration is in a range of 0.5 to 45 wt. % preferably 1 to 30 wt. % especially 1 to 15 wt. %. It is possible to use a white liquor (aqueous solution of sodium sulfide and sodium hydroxide) or a green liquor (aqueous solution of sodium sulfide and sodium carbonate) stored in a paper factory.

The reducing agent for reducing AQ or the AQ derivatives into AHQ or the AHQ derivatives can be inorganic or organic reducing agents. The typical inorganic reducing agents include hydrosulfites such as sodium hydrosulfite; zinc; and sodium borohydride. The typical organic reducing agent include carbohydrates such as monosaccharides such as glucose, galactose, xylose, and mannose; disaccharides such as sucrose, cellobiose and maltose; oligosaccharides such as raffinose; polysaccharides such as starch and xylan; amines such as ethylenediamine, diethylenetriamine and ethanolamine; and aldehydes such as formaldehyde and acetaldehyde.

The amount of the reducing agent is in a range of 0.5 to 10 times, preferably 1 to 6 times, the stoichiometric amount of the reducing agent required for reducing AHQ or the AHQ derivative corresponding to the adhered AQ or the AQ derivative. The concentration of the reducing agent is in a range of 0.3 to 30 wt. % based on solution components.

The optimum reducing agent used in the present invention is hydrosulfite, especially sodium hydrosulfite. The reducing reaction is considered to be as follows:

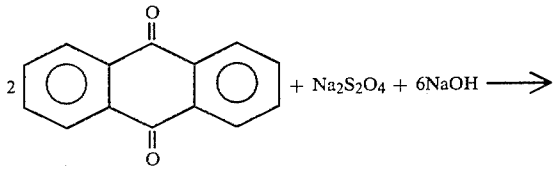

-continued

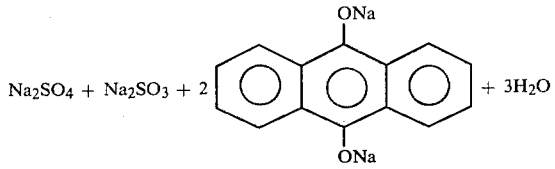

Thus, the stoichometric amount of sodium hydrosulfite is ½ mole per mole of AQ. The ratio of sodium hydrosulfite to AQ is 0.42 by weight. In the practical process, the purpose for removal is attained by using sodium hydrosulfite at a ratio of 0.5 to 10 based on AQ. When the ratio is too small, the complete dissolution of the AQ component is not attained but the removal of the scale may be attained. When it is desired to completely dissolve the AQ component, it is necessary to use relatively large amount of the reducing agent. However, it is not economical to use large quantities.

In the preferred embodiment, sodium hydroxide is used at a ratio of 0.6 to 5 by weight and sodium hydrosulfite is used at a ratio of 0.5 to 4 by weight based on the AQ component in the scale.

In the process of the present invention, the temperature utilized is dependent upon the reducing agent and ranges 50° to 150° C., usually 50° C. to a boiling point, preferably 50° to 100° C. When hydrosulfite is used, it is usually in the range 50° to 100° C., preferably 50° to 70° C.

The following process can be usually employed for the heat-treatment of the scale adhered on the equipment and the pipe with an aqueous solution of a base in the industrial scale.

An aqueous solution of sodium hydroxide at a desired concentration is heated at 60° to 100° C. in a service tank and the aqueous solution of sodium hyroxide is fed by the pump into the equipment and the pipe on which the scale is adhered and the aqueous solution of sodium hydroxide is recycled by the pump between the service tank and the equipment. The flow rate is preferably to flow the peeled scale. It is possible to remove the scale by placing a sedimentation tank in a recycling line.

The aqueous solution dispersing the insoluble matter such as the AQ component with a surfactant can be mixed with a white liquor for digestion of pulp.

When the reducing agent such as hydrosulfite is incorporated in the aqueous solution of sodium hydroxide, it is preferable to charge the reducing agent in nitrogen atmosphere.

When the aqueous solution of the base is recycled for about 1 to 4 hours, the scale is substantially removed. After the treatment, the aqueous solution is discharged and the equipment is washed with water.

It is possible to recycle an aqueous solution of a base at a concentration of 0.5 to 30 wt. % at 50° to 100° C. followed by recycling an aqueous solution of a base and a reducing agent through the equipment on which the scale is adhered.

It is preferable to incorporate a surfactant in the aqueous base solution.

The surfactant can be any alkali resistant cationic, nonionic or anionic surfactants such as aliphatic sulfonates such as dioctylsulfosuccinate; aromatic sulfonates such as dodecylbenzenesulfonates, naphthalenesulfonate-formaline condensates, and ligninsulfonates; amines such as polyoxyethylene-octadecylamines; cationic surfactants such as trimethyl hexadecylammonium bromide; nonionic surfactants such as polyoxyethylene-higher alcohol ethers, polyoxyethylenealkylphenol-formaline condensate ethers, polyoxyethylenesorbitane aliphatic acid esters, polyoxyethylene aliphatic acid esters and aliphatic acid alkanolamides; amorphous surfactants such as aminocarboxylates and carboxybetaine amorphous surfactants; and fluorinated surfactants such as fluoroalkylcarboxylic acids.

The amount of the surfactant is usually in the range 1 ppm to 1% based on the aqueous solution of a base.

In accordance with the present invention, it is especially important to remove the anthraquinone type scale adhered on the evaporator condenser wall especially a multiple effect evaporator in the concentration of the black liquor.

The present invention will be illustrated by the following examples, which are provided for purposes of illustration only and are not intended to limit the invention.

REFERENCE

We sampled three kinds of scales (A, B and C) adhered on walls of three steam condensers of a multiple effect evaporator. Each sampled scale (about 3 g) was charged into a 100 ml conical flask and 60 ml of 1% aqueous solution of sodium hydroxide was charged into each flask. The mixture was stirred at 85° C. and degradation of each scale was observed. After about 1 hour, most of the scale was dispersed and precipitated as fine particles. The precipitate was well dispersed by stirring. When a surfactant was added to the dispersion, the insoluble matter such as the AQ component was well dispersed in the solution.

The analysis of the solid components in each scale A, B or C showed the following results.

| | Component | | |
|---|---|---|---|
| Scale | AQ component (%) | Oily component (%) | Other component (%) |
| A | 85 | 10 | 5 |
| B | 68 | 22 | 10 |
| C | 33 | 15 | 52 |

EXAMPLE 1

A black liquor obtained in the kraft process using DDA Na (disodium salt of 1,4-dihydroanthrahydroquinone) as a digesting assistant was continuously concentrated by a pentaple effect evaporator whereby a scale was adhered on about ⅓ of shell surface of a heat-exchanger (a concentrated liquid is passed through inside of multiple pipes and a steam is passed in a shell) of the fifth evaporator (the black liquor is firstly fed to be concentrated at the lowest temperature and the lowest concentration and a steam of the fourth evaporator is fed) of the multiple effect evaporator. A thickness of the scale was about 3 mm. The scale contained 60 wt. % of water and the solid component of the scale containing 65 wt. % of AQ component and 27% of oily component.

The fifth evaporator was heat-treated with an aqueous solution of sodium hydroxide by the following manner. In an about 50 $m^3$ service tank, 3% aqueous solution of sodium hydroxide was prepared and was heated at about 80° C. The heated aqueous solution was fed from the bottom in the shell side (about 15 $m^3$) of the fifth evaporator on which the scale was adhered to be substantially filled and was further fed at a rate of 50 $m^3$/hour from the bottom and was recycled from the top of the evaporator into the service tank under steaming to heat it at 80° C. After about 1 hour, the scale was substantially peeled off to expose the bare surface of the heat exchange pipes in the shell. The surface of the evaporator was washed with water and then, the concentration of the black liquor was carried out. The heat exchange efficiency was recovered.

EXAMPLE 2

A scale was adhered on a surface of a shell in a steam side, a drain pipe and a drain pump of a fifth evaporator of a pentaple effect evaporator for concentrating a black liquor containing AQ component. The scale contained 50 to 80 wt, % of water and the solid component of the scale contained 55 to 70 wt. % of AQ component and 10 to 30 wt. % of oily component and a remainder of inorganic salts.

An estimated amount of the AQ component in the three equipment system was 100 kg. A 40 $m^3$ closed type service tank and a recycling pump (flow rate of 1 $m^3$/min) were connected. In the service tank, 400 kg of sodium hydroxide was dissolved into 20 $m^3$ of water and the solution was heated to about 60° C. and 300 kg of sodium hydrosulfite was charged in nitrogen atmosphere into the tank. After the dissolution of sodium hydrosulfite, the solution was filled in the shell in the steam side of a carandria of the fifth evaporator by the recycling pump and the overflowed solution was recycled into the service tank. After about 2 hours, the scale was completely peeled off, and most of AQ component was dissolved to form reddish brown color. All of the aqueous solution was returned into the service tank. The carandria (heat-exchange pipes) was washed with water and then, the concentration was carried out by the evaporator. The heat-exchange efficiency was completely recovered.

EXAMPLE 3

A scale having a thickness of about 3 mm was adhered on about ⅓ of the lower part of the shell in the steam side of a fifth evaporator of a pentaple effect evaporator by concentrating a black liquor containing AQ component. Therefore, the heat exchange efficiency of the evaporator was remarkably reduced.

The scale contained 60 wt. % of water and the solid component of the scale contained about 65 wt. % of AQ component. A total amount of the AQ component in the scale adhered on the evaporator was about 300 kg.

A 70 $m^3$ closed type service tank and a recycling pump (flow rate of 1 $m^3$/min) were connected to the shell in the steam side of the carandria of the evaporator. The carandria had an inlet at the lower position and an outlet at the upper position. In the service tank, 50 $m^3$ of water and 1,000 kg of sodium hydroxide were charged to prepare 2% aqueous solution of sodium hydroxide. The aqueous solution was heated at 80° to 90° C. and was fed into the shell in the steam side of the carandria and recycled for 1 hour to perform a preliminary washing. The aqueous solution was cooled at 50° to 60° C. and 600 kg of sodium hydrosulfite ($Na_2S_2O_4$) was dissolved in the aqueous solution. The aqueous solution at 50° to 60° C. was fed into the carandria to recycle it for 1 hour. The aqueous solution had reddish brown color. The treated solution was discharged through a white liquor line and the inside of the carandria was washed with water. Any scale was not remained on the surface of the shell in the steam side of the carandria. The concentration was carried out by the evaporator. The heat-exchange efficiency was completely recovered.

EXAMPLE 4

The scale having a thickness of 3 mm adhered on the evaporator was sampled. Various tests for dissolving the scale were carried out under various reducing conditions by using each aqueous solution containing 7.5 g of sodium hydroxide, 250 g of water and each amount of the reducing agent shown in Table. The scale in dry contained 67 wt. % of AQ component.

TABLE

| Reducing agent (stoichiometric amount) | Reducing condition temp. time | Condition of scale after heat treatment | Reducing percent of AQ (%) |
|---|---|---|---|
| glucose (2.5) | 80° C.:1 hr. | Degradation of scale and partially dispersed | 50% |
| starch (2.5) | 145° C.:1 hr. | Degradation of scale and partially dispersed | 50% |
| sodium hydrosulfite (2.5) | 80° C.:1 hr. | substantially uniform solution | 95% |
| zinc (2.5) | 80° C.:1 hr. | substantially uniform solution | 98% |
| hydrazine (3) | 80° C.:1 hr. | Degradation of scale and partially dispersed | 40% |
| glucose (6) | 80° C.:1 hr. | substantially uniform solution | 90% |

We claim:

1. A process for removing an anthraquinone type scale formed on condenser surfaces upon condensation of a vapor evaporated from a black liquor, said black liquor being obtained by separating pulp from a digested mixture of lignocelluloses containing an anthraquinone type digesting assistant, the process comprising: contacting said surfaces having anthraquinone scales adhered thereto with a heated aqueous solution of a base and a reducing agent selected from the group consisting of hydrosulfites, zinc, sodium borohydride, saccharides, amines and aldehydes, wherein said base and said reducing agent are used in the ratios 0.6 to 5.0 by weight and 0.5 to 10.0 of the stoichiometric amount, respectively, based on the anthraquinone component in the scale.

2. The process according to claim 1, wherein the contacting of the anthraquinone type scale with the heated aqueous solution of base is carried out in the presence of a reducing agent and an alkali resistant surfactant.

3. The process according to claim 1, wherein said evaporation is carried out in a multiple effect evaporator.

4. The process according to claim 1, wherein said condenser surfaces are heat exchanging surfaces or surfaces of a passage for said vapor.

5. The process according to claim 1, wherein said heated aqueous solution of a base is an aqueous solution of an alkali metal hydroxide, carbonate or bicarbonate or ammonia.

6. The process according to claim 1, wherein said heated aqueous solution of a base is an aqueous solution of sodium hydroxide.

7. The process according to claim 6, wherein said heated aqueous solution of sodium hydroxide has a concentration of sodium hydroxide of from 0.5 wt. % to the solubility limit of sodium hydroxide.

8. The process according to claim 7, wherein said heated aqueous solution of sodium hydroxide has a concentration of sodium hydroxide of from 1 to 30 wt. %.

9. The process according to claim 1, wherein said heated aqueous solution of a base is heated to a temperature of from 50° C. to the boiling point of the aqueous solution.

* * * * *